US009761988B1

(12) United States Patent
Lin

(10) Patent No.: US 9,761,988 B1
(45) Date of Patent: Sep. 12, 2017

(54) WATERPROOF ELECTRIC CONNECTOR ASSEMBLY

(71) Applicant: ASSEM TECHNOLOGY Co., LTD., New Taipei (TW)

(72) Inventor: I-Hsiu Lin, New Taipei (TW)

(73) Assignee: ASSEM TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/408,681

(22) Filed: Jan. 18, 2017

(51) Int. Cl.

| | |
|---|---|
| ***H01R 13/648*** | (2006.01) |
| ***H01R 13/52*** | (2006.01) |
| ***H01R 24/64*** | (2011.01) |
| ***H01R 13/6581*** | (2011.01) |
| ***H01R 13/405*** | (2006.01) |
| ***H01R 13/502*** | (2006.01) |
| *H01R 107/00* | (2006.01) |

(52) U.S. Cl.
CPC ..... *H01R 13/521* (2013.01); *H01R 13/405* (2013.01); *H01R 13/502* (2013.01); *H01R 13/5202* (2013.01); *H01R 13/6581* (2013.01); *H01R 24/64* (2013.01); *H01R 2107/00* (2013.01)

(58) Field of Classification Search
CPC ..... H01R 23/7073; H01R 13/5219; H01R 13/5208; H01R 23/688; H01R 13/65802; H01R 23/6873; H01R 13/658
USPC ..... 439/79, 271, 587, 589, 607.05, 607.27, 439/607.35–607.37, 607.55, 660
See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,092,252 | B2 * | 1/2012 | Peng | H01R 12/724 439/352 |
| 8,348,688 | B2 * | 1/2013 | Liu | H01R 13/5219 439/271 |
| 8,662,928 | B1 * | 3/2014 | Xie | H01R 12/724 439/607.35 |
| 8,827,742 | B2 * | 9/2014 | Wang | H01R 24/68 439/569 |
| 9,385,484 | B2 * | 7/2016 | Chen | H01R 13/6582 |
| 9,496,664 | B2 * | 11/2016 | Little | H01R 13/6587 |
| 9,634,425 | B1 * | 4/2017 | Hsu | H01R 13/5202 |

* cited by examiner

*Primary Examiner* — Thanh Tam Le
(74) *Attorney, Agent, or Firm* — Muncy, Geissler, Olds & Lowe, P.C.

(57) ABSTRACT

A waterproof electric connector assembly includes an electrically insulative housing including an accommodation chamber, a front opening, a recessed bottom chamber and two locating devices at two opposite lateral sides thereof, a metal shielding cover covered on the top side of the rear opening and having plug rods respectively fastened to the locating devices of the electrically insulative housing, an electric connector including an electrically insulative terminal block mounted in the accommodation chamber, a tongue plate extended from the electrically insulative terminal block and a conducting terminal set mounted in the electrically insulative terminal block with conducting terminal contact portions thereof respectively arranged on opposing top and bottom walls of the tongue plate and conducting terminal bonding portions thereof extended out of the recessed bottom chamber of the electrically insulative housing, and a waterproof adhesive sealed up the recessed bottom chamber.

6 Claims, 10 Drawing Sheets

WATERPROOF ELECTRIC CONNECTOR ASSEMBLY

BACKGROUND OF THE INVENTION

1. Field of the Invention

The present invention relates to electric connector technology and more particularly, to a waterproof electric connector assembly, which includes an electrically insulative housing, an electric connector mounted in the electrically insulative housing with conducting terminal contact portions thereof extended out of a recessed bottom chamber of the electrically insulative housing, a metal shielding cover covering a top opening of the recessed bottom chamber, and a waterproof adhesive sealed in the recessed bottom chamber to achieve excellent waterproofing.

2. Description of the Related Art

With the progress of electronic technology, many electronic and electrical products have been continuously created, bringing comfort and convenience to people's works and lives but also leading to our increased reliance on electronic and electrical products. Through a variety of electronic signal applications, we can operate and control a variety of electronic and electrical products. With continuous improvement in electronic and electrical product production, the functions of electronic and electrical products have also been greatly improved. Subject to improvements on electronic signal applications and creation of advanced electric connectors and signal transmission interfaces, electronic signal transmission speed has been significantly enhanced. There are known various electronic signal transmission interfaces and electric connectors of different kinds and sizes for different applications. An advanced electronic product has installed therein various different electronic signal transmission interfaces and electric connectors to satisfy different signal transmission requirements. In consequence, advanced electronic products must provide sufficient installation space for the installation of various different electronic signal transmission interfaces and electric connectors.

An electric connector generally comprises an electrically insulative core member, a plurality of conducting terminals inserted through the electrically insulative core member, and a metal shielding shell surrounding the electrically insulative core member. The metal shielding shell is a metal sheet member stamped into shape and wrapped about the electrically insulative core member. After the metal shielding shell is wrapped about the electrically insulative core member, gaps are left around the border edges of the metal shielding shell. In the application of the electric connector, external moisture can permeate through the gaps around the border edges of the metal shielding shell into the circuit board to which the conducting terminals are bonded, causing a short circuit, circuit board damage or component burnt out.

Therefore, how to solve the problem of moisture permeation in the outer metal shell of an electric connector that can result in a short circuit in the circuit board or circuit board failure is the direction of improvement this industry-related manufacturers need to go to.

SUMMARY OF THE INVENTION

The present invention has been accomplished under the circumstances in view. It is therefore the main object of the present invention to provide a waterproof electric connector assembly, which has a gasket ring mounted on a front side thereof and a waterproof adhesive sealed in recessed bottom chamber thereof to achieve excellent waterproofing.

To achieve this and other objects of the present invention, a waterproof electric connector assembly comprises an electrically insulative housing, a metal shielding cover, an electric connector and a waterproof adhesive. The electrically insulative housing comprises an accommodation chamber, a front opening located in a front side thereof and disposed in communication with the accommodation chamber, a recessed bottom chamber located in a rear bottom side thereof, and two locating devices respectively at two opposite lateral sides thereof. The metal shielding cover surrounds the electrically insulative housing, comprising two positioning means respectively extended from two opposite lateral sides of the flat metal cover body and respectively fastened to the locating devices of the electrically insulative housing. The electric connector is mounted in the accommodation chamber of the electrically insulative housing, comprising an electrically insulative terminal block, a tongue plate forwardly extended from a front side of the electrically insulative terminal block and inserted through the front opening of the electrically insulative housing, a metal shielding shell surrounding the electrically insulative terminal block and the tongue plate, and a conducting terminal set embedded in the electrically insulative terminal block. The conducting terminal set comprises a plurality of conducting terminal contact portions located at a front side thereof and respectively positioned in opposing top and bottom walls of the tongue plate, and a plurality of conducting terminal bonding portions located at an opposing rear side thereof and extended out of the recessed bottom chamber of the electrically insulative terminal block. The waterproof adhesive seals up the recessed bottom chamber of the electrically insulative housing to achieve the expected waterproof function.

According to another aspect of the present invention, the electrically insulative housing further comprises a plurality of through holes cut through a back wall thereof and disposed in communication with the recessed bottom chamber, and a back cover sheet detachably attached to the back wall thereof to cover the through holes before filling of the waterproof adhesive in the recessed bottom chamber. Further, the back cover sheet is selected from the group of Mylar film, plastic film and silicone film.

In one embodiment of the present invention, each locating device of the electrically insulative housing comprises a locating block formed integral with an outside wall of the electrically insulative housing, and a plug hole defined in the locating block. In this embodiment, the metal shielding cover further comprises two L-shaped mounting flanges respectively extended from the two opposite lateral sides of the flat metal cover body. Further, each positioning means comprises a plug rod extended from the flat metal cover body and plugged into the plug hole in the respective locating block of the respective locating device.

In another embodiment of the present invention, each locating device of the electrically insulative housing comprises two stop blocks, and a position-limiting insertion hole defined between the two stop blocks. In this embodiment, each positioning means of the metal shielding cover comprises an angled plug rod extended from respective one side of the metal cover body and positioned in the respective position-limiting insertion hole between the respective two stop blocks of the respective locating device to secure the metal shielding cover to the electrically insulative housing.

Further, the metal shielding shell defines therein an insertion chamber that accommodates the tongue plate. Thus, the insertion chamber of the metal shielding shell, the tongue plate and the conducting terminal contact portions of the conducting terminal set constitute a plug-in unit conforming to the Universal Serial Bus (USB Type-C) specification.

Further, the electrically insulative housing is molded on the electric connector using insert molding technology, allowing the metal shielding shell, the tongue plate and the conducting terminal contact portions of the conducting terminal set to be partially extended out of the front opening of the electrically insulative housing.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
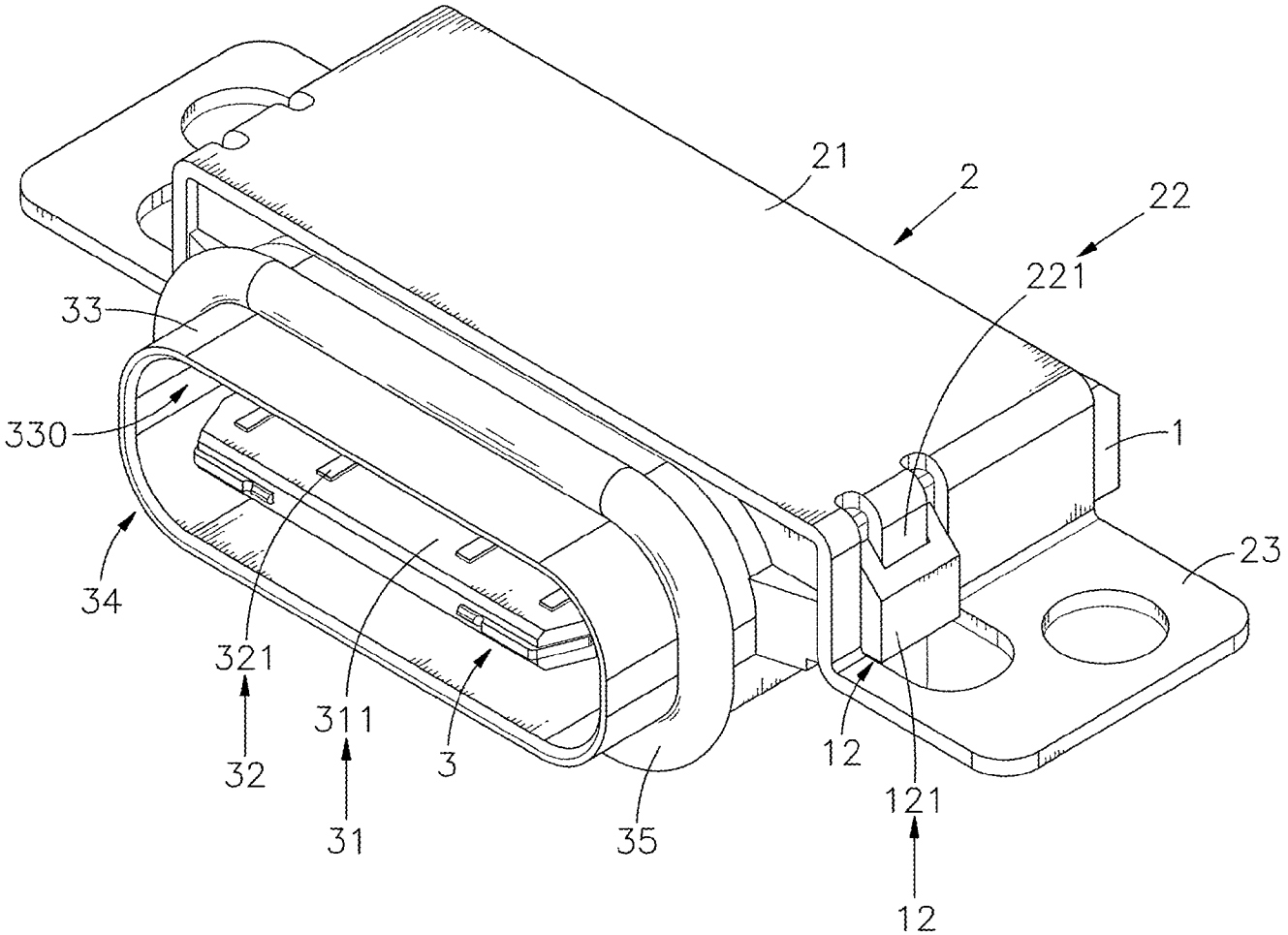
FIG. 1 is an oblique front elevational view of a waterproof electric connector assembly in accordance with a first embodiment of the present invention.
Figure 2:
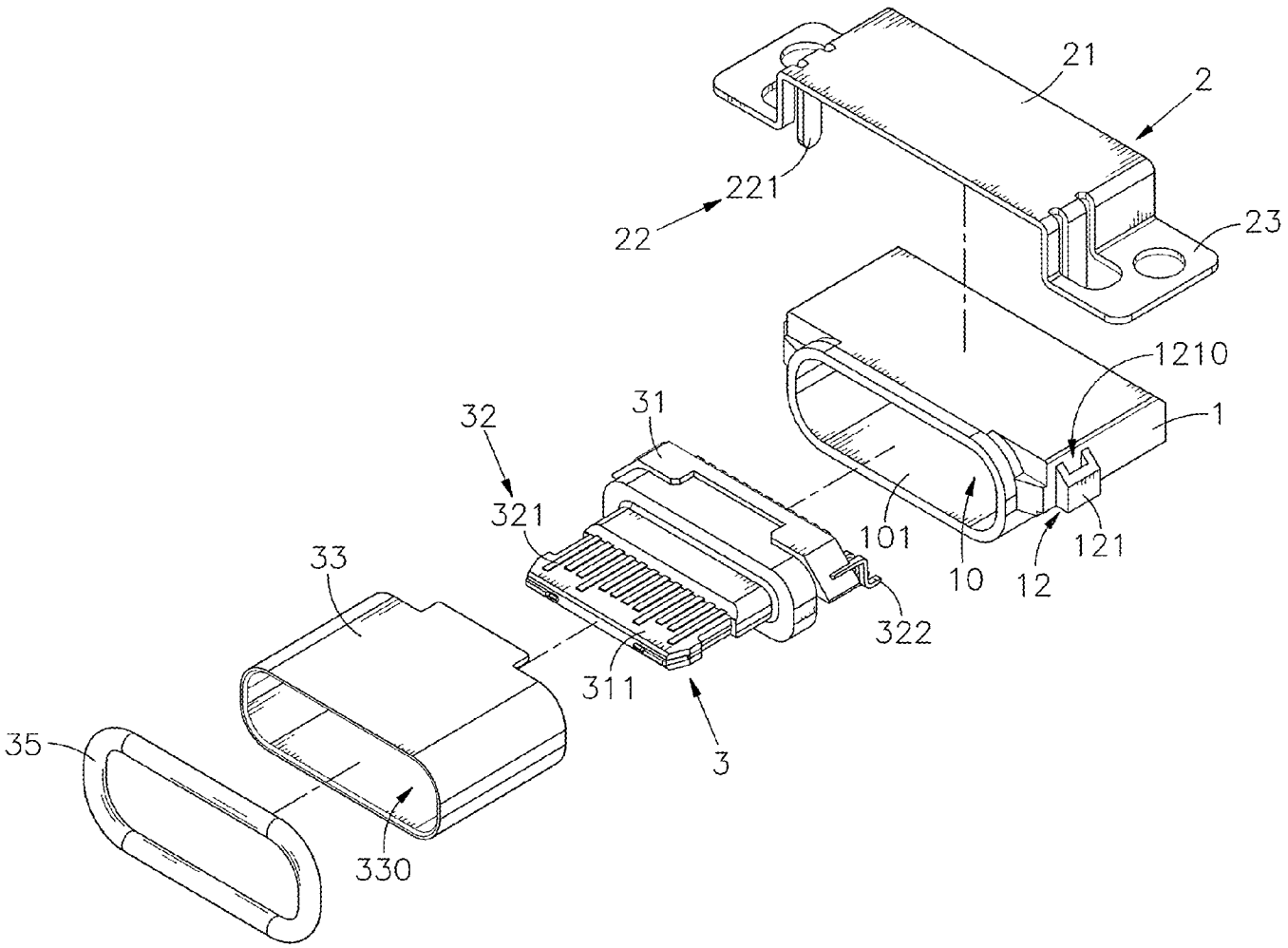
FIG. 2 is an exploded view of the waterproof electric connector assembly in accordance with the first embodiment of the present invention.
Figure 3:
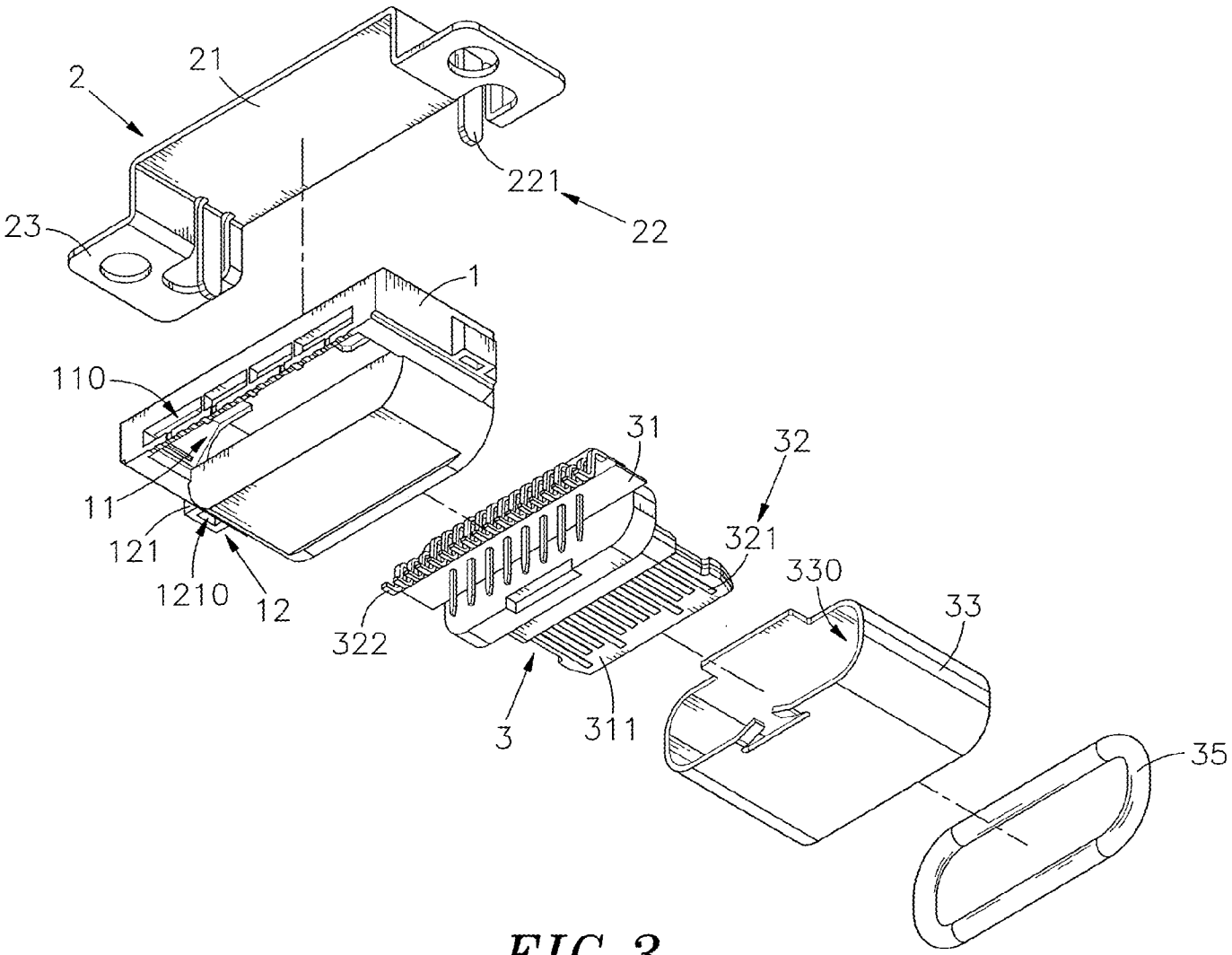
FIG. 3 is another exploded view of the waterproof electric connector assembly in accordance with the first embodiment of the present invention when viewed from another angle.
Figure 4:
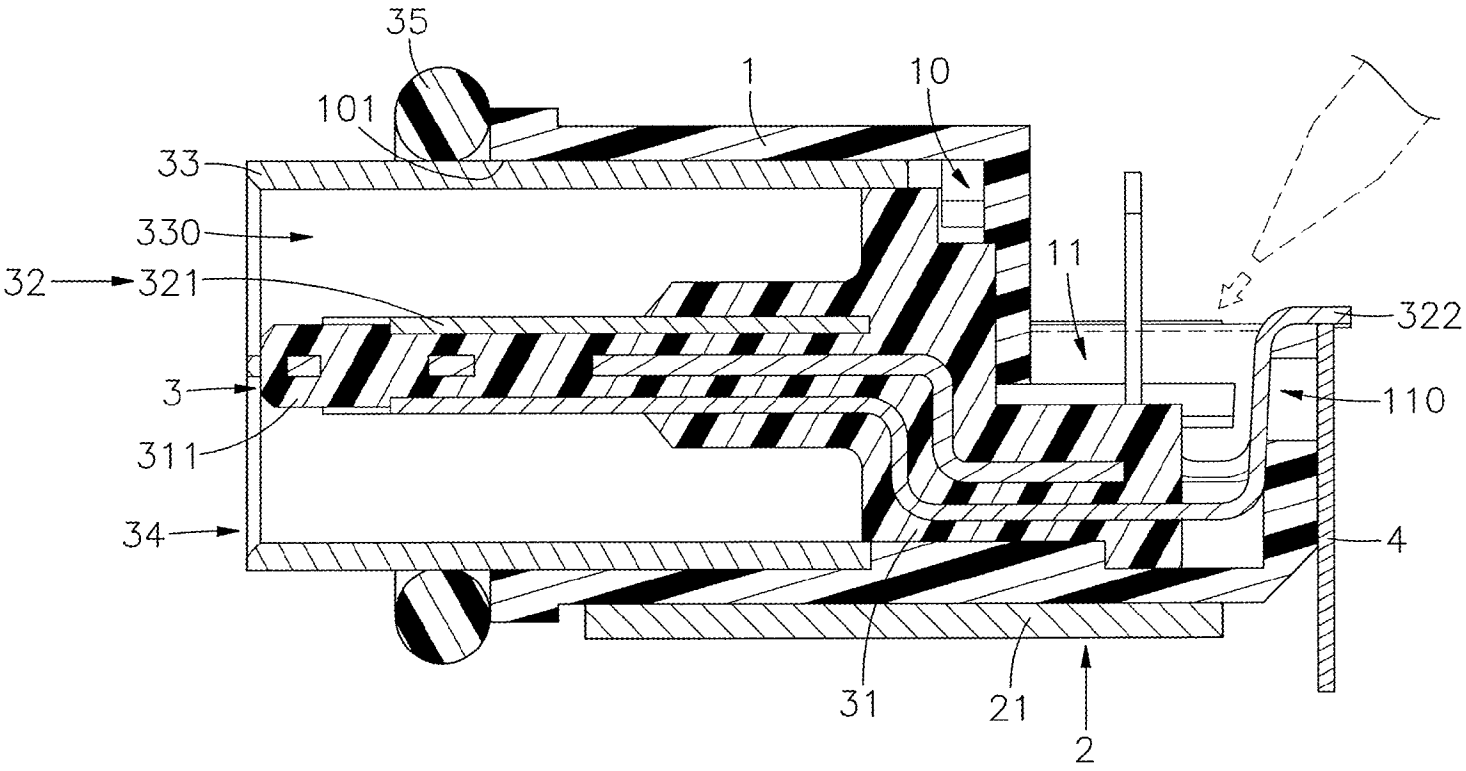
FIG. 4 is a schematic sectional side view of the first embodiment of the present invention during the waterproof adhesive filling operation.
Figure 5:
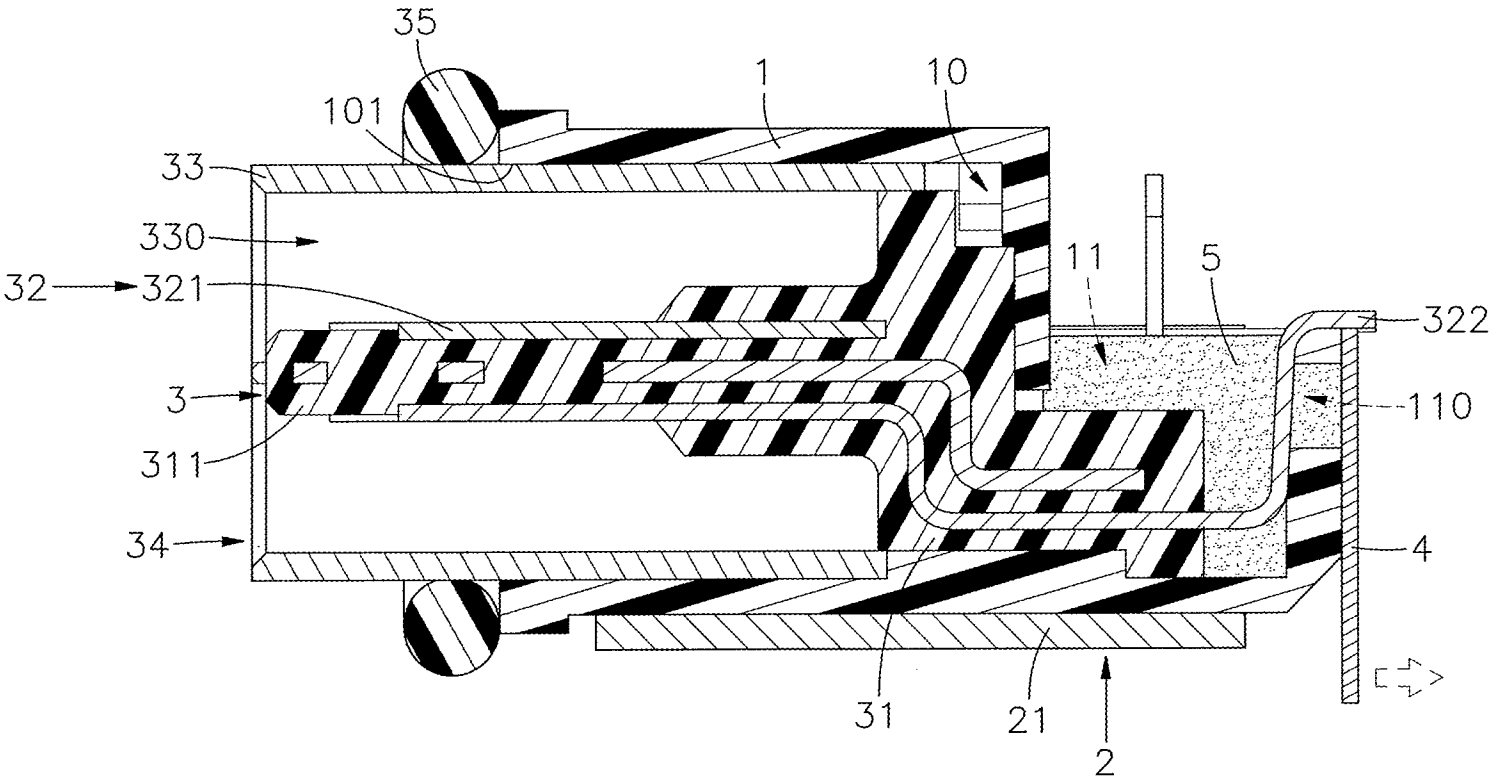
FIG. 5 is a schematic sectional side view of the first embodiment of the present invention illustrating the recessed bottom chamber the electrically insulative housing filled up with the waterproof adhesive.
Figure 6:
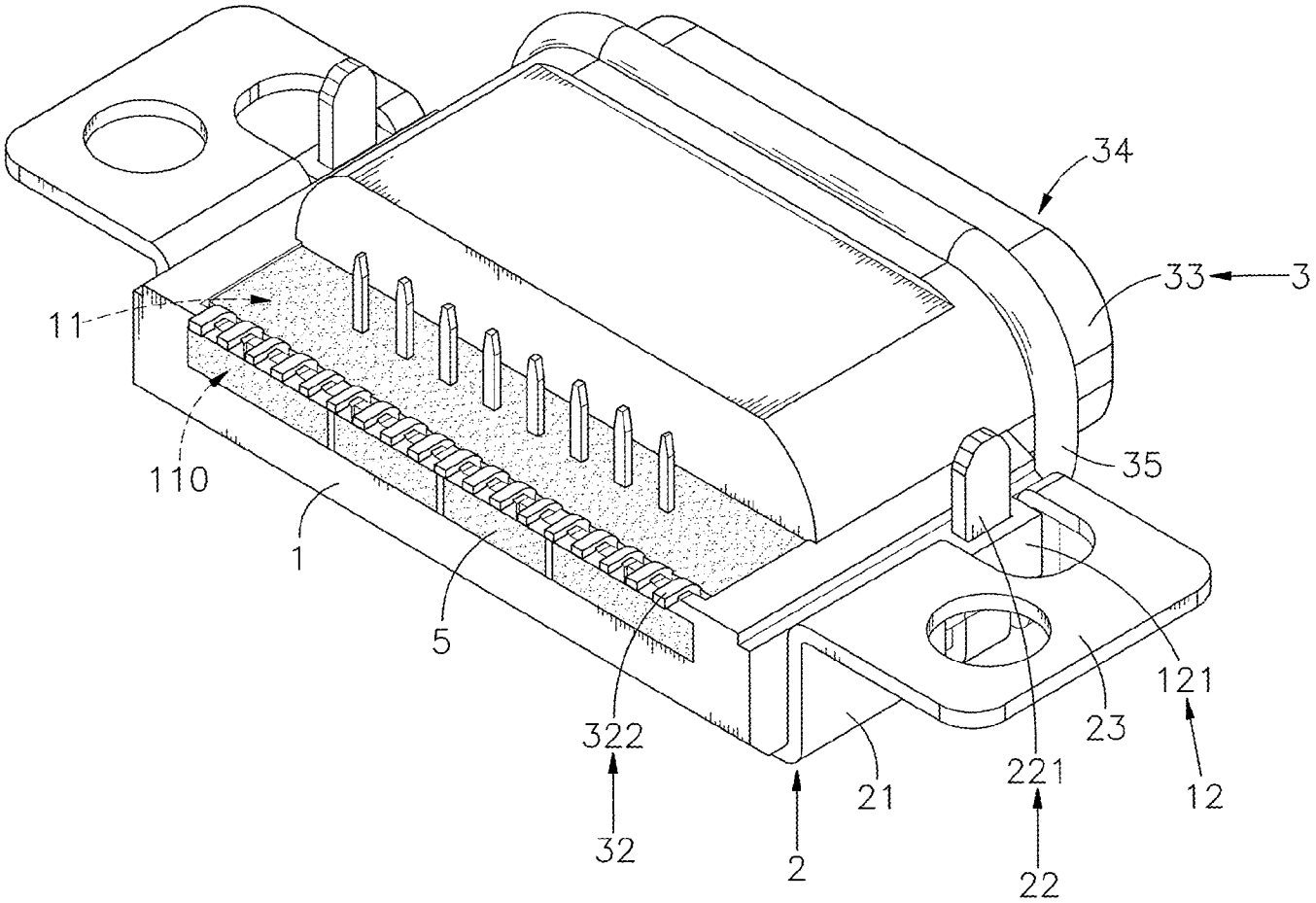
FIG. 6 is an oblique rear elevational upside-down view of the waterproof electric connector assembly in accordance with the first embodiment of the present invention.
Figure 7:
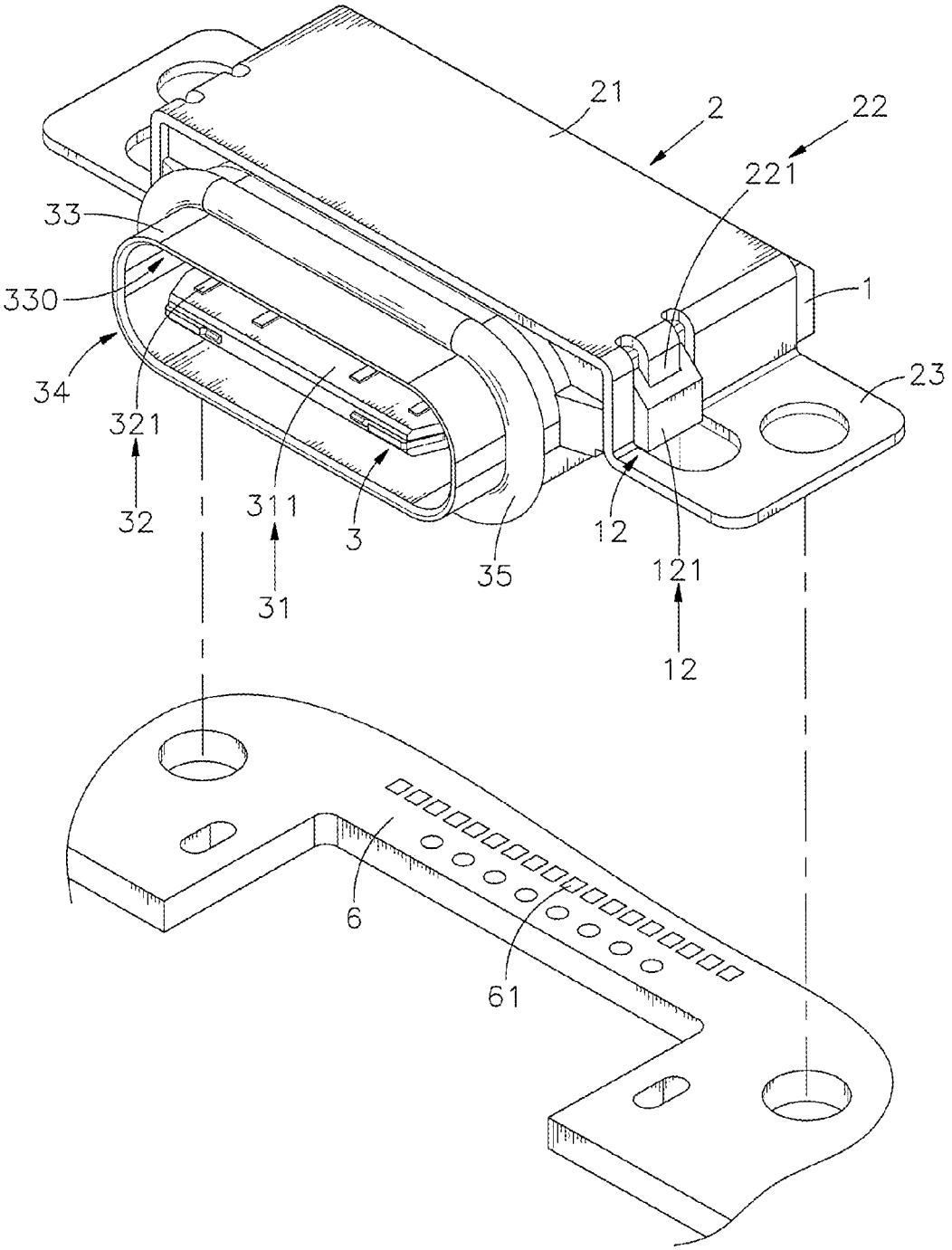
FIG. 7 is an exploded view of the waterproof electric connector assembly and a mating circuit board in accordance with the first embodiment of the present invention.

Referring to FIGS. 1-3, a waterproof electric connector assembly in accordance with a first embodiment of the present invention is shown. The waterproof electric connector assembly comprises an electrically insulative housing 1, a metal shielding cover 2 and an electric connector 3.

The electrically insulative housing 1 comprises an accommodation chamber 10, a front opening 101 located on a front side thereof in communication with the accommodation chamber 10, a recessed bottom chamber 11 located in a bottom side thereof at a back side relative to the accommodation chamber 10 and disposed in communication with the accommodation chamber 10, a plurality of through holes 110 cut through a back wall thereof and disposed in communication with the recessed bottom chamber 11, and two locating devices 12 located at two opposite lateral sides thereof.

The metal shielding cover 2 comprises a flat metal cover body 21, and two positioning means 22 respectively extended from two opposite lateral sides of the flat metal cover body 21.

The electric connector 3 comprises an electrically insulative terminal block 31, a conducting terminal set 32 embedded in the electrically insulative terminal block 31, and a metal shielding shell 33 surrounding the electrically insulative terminal block 31. The electrically insulative terminal block 31 comprises a tongue plate 311 forwardly extended from a front side thereof. The conducting terminal set 32 has conducting terminal contact portions 321 thereof respectively arranged on opposing top and bottom surfaces of the tongue plate 311, and opposing conducting terminal bonding portions 322 thereof respectively extended out of an opposing rear side of the electrically insulative terminal block 31. The metal shielding shell 33 surrounds the electrically insulative terminal block 31 and the tongue plate 311, defining therein an insertion chamber 330 that accommodates the electrically insulative terminal block 31 and the tongue plate 311. Thus, the insertion chamber 330 of the metal shielding shell 33, the tongue plate 311 and the conducting terminal contact portions 321 of the conducting terminal set 32 constitute a plug-in unit 34 conforming to the Universal Serial Bus (USB Type-C) specification. Further, a gasket ring 35 is mounted around the plug-in unit 34.

When assembling the waterproof electric connector, attach the metal shielding cover 2 to the top side of the electrically insulative housing 1 to force the positioning means 22 of the metal shielding cover 2 into engagement with the respective locating devices 12 of the electrically insulative housing 1, and then mount the electrically insulative terminal block 31, tongue plate 311, conducting terminal set 32 and metal shielding shell 33 of the electric connector 3 in the accommodation chamber 10 of the electrically insulative housing 1, enabling the plug-in unit 34 to be extended out of the accommodation chamber 10 and the front opening 101 with the gasket ring 35 stopped at a front edge of the electrically insulative housing 1 around the front opening 101 and the conducting terminal bonding portions 322 of the conducting terminal set 32 of the electric connector 3 to be extended out of the accommodation chamber 110 and the recessed bottom chamber 11. Thus, the electrically insulative housing 1, the metal shielding cover 2 and the electric connector 3 are assembled to form an electric connector assembly.

Further, each locating device 12 of the electrically insulative housing 1 comprises a locating block 121 and a plug hole 1210 defined in the locating block 121. The metal shielding cover 2 further comprises two L-shaped mounting flanges 23 respectively extended from the two opposite lateral sides of the flat metal cover body 21. Each positioning means 22 comprises a plug rod 221. The plug rods 221 of the positioning means 22 are respectively and vertically downwardly extended from the two opposite lateral sides of the flat metal cover body 21 and respectively plugged into the plug holes 1210 in the locating blocks 121 of the respective locating devices 12 to secure the metal shielding cover 2 firmly to the electrically insulative housing 1.

Referring to FIGS. 4-7 and FIGS. 2 and 3 again, after mounted the electric connector 3 in the electrically insulative housing 1 and covered the metal shielding cover 2 over the electrically insulative housing 1, fasten a back cover sheet 4 to the back wall of the body 11 to block the through holes 110 and to prevent an overflow of an applied waterproof adhesive during a waterproof filling operation, and then fill up the recessed bottom chamber 11 with a waterproof adhesive 5 to seal up the recessed bottom chamber 11. Thus, the area around the front opening 101 of electrically insulative housing 1 is sheltered by the gasket ring 35, the conducting terminal contact portions 321 of the conducting terminal set 32 at the opposing top and bottom walls of the tongue plate 311 of the electric connector 3 are isolated from the recessed bottom chamber 11. After the waterproof adhesive 5 in the recessed bottom chamber 11 is cured, remove the back cover sheet 4 from the through holes 110 of the electrically insulative housing 1. Thus, the recessed bottom chamber 11 of the electrically insulative housing 1 is well sealed by the waterproof adhesive 5 and the area around the front opening 101 is shield and stopped by the gasket ring 35, enabling the electrically insulative housing 1 to achieve a multi-stage waterproof effect.

When mounting the waterproof electric connector assembly on a circuit board 6, bond the conducting terminal bonding portions 322 of the conducting terminal set 32 to respective metal contacts 61 of the circuit board 6 to electrically connect the electric connector 3 to the circuit board 6. When an external mating electric connector is connected to the plug-in unit 34 of the waterproof electric connector assembly, the gasket ring 122 around the plug-in unit 34 is tightly abutted against an inside wall of the external mating electric connector to seal the gap, prohibiting external moisture from passing through the front opening 101 of the electrically insulative housing 1 into the accommodation chamber 10 and recessed bottom chamber 11 to damage the circuit board 6. Thus, the invention greatly enhances the waterproof effect of the waterproof electric connector assembly in application.

Figure 8:
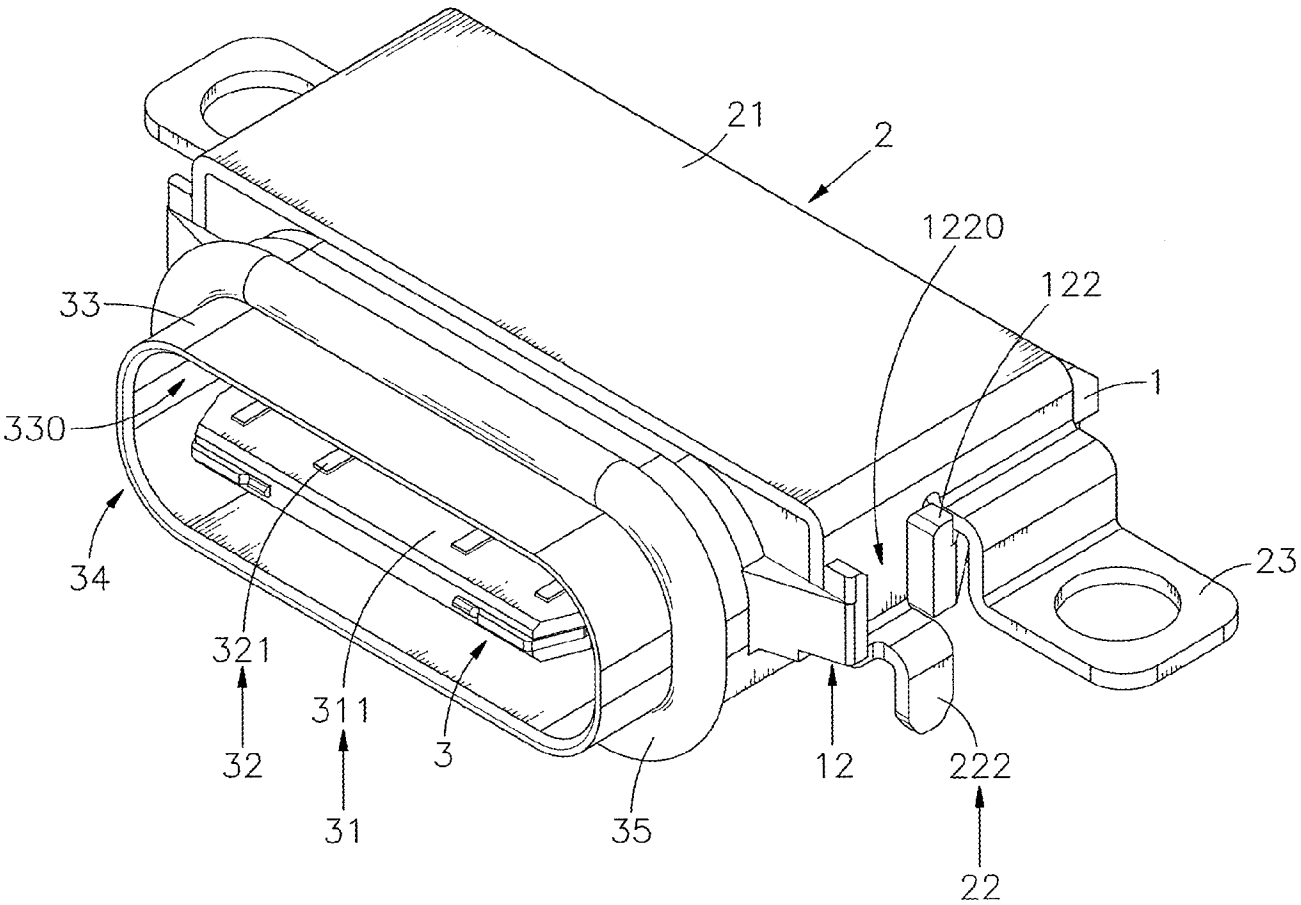
FIG. 8 is an oblique front elevational view of a waterproof electric connector assembly in accordance with a second embodiment of the present invention.
Figure 9:
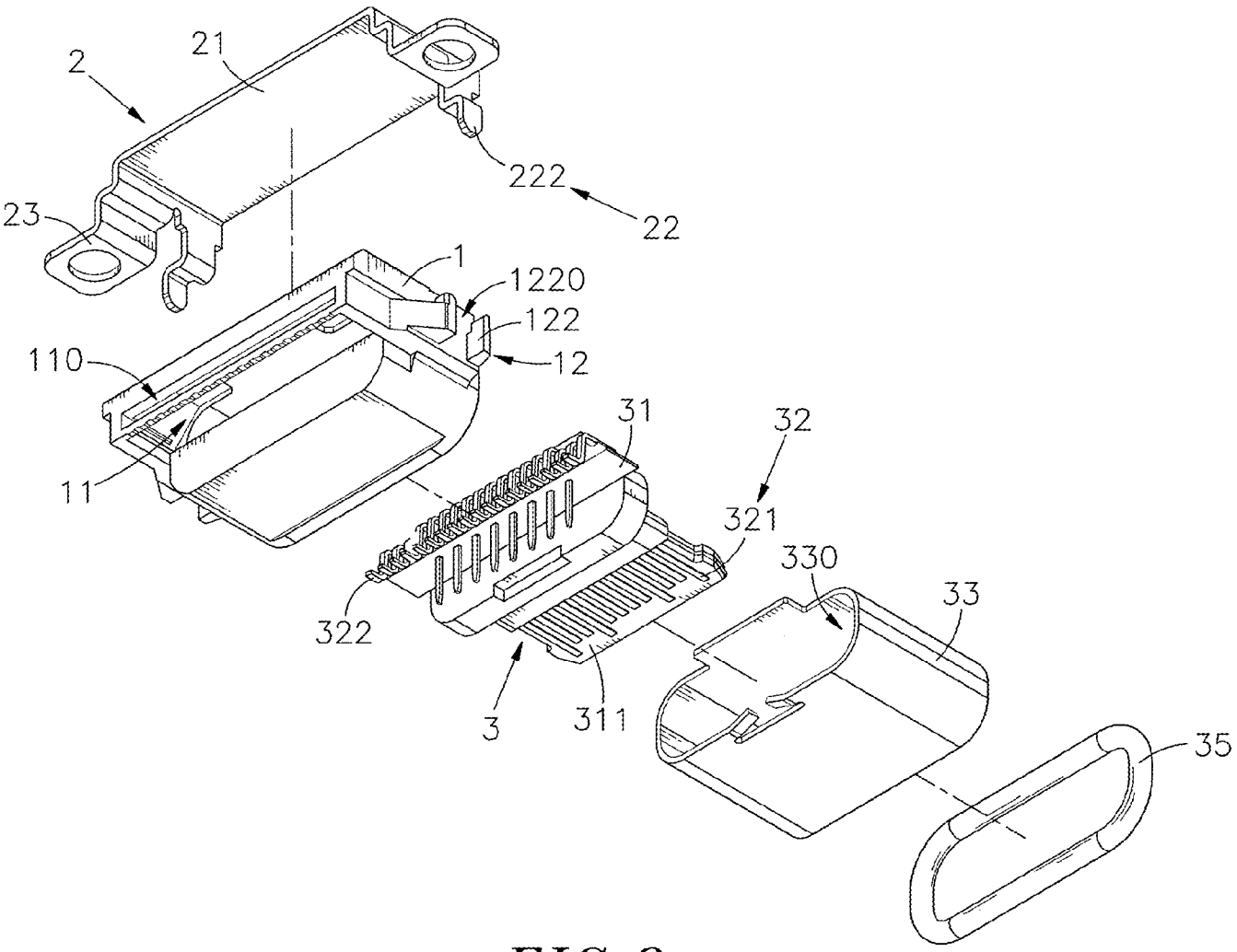
FIG. 9 is an exploded view of the waterproof electric connector assembly in accordance with the second embodiment of the present invention.
Figure 10:
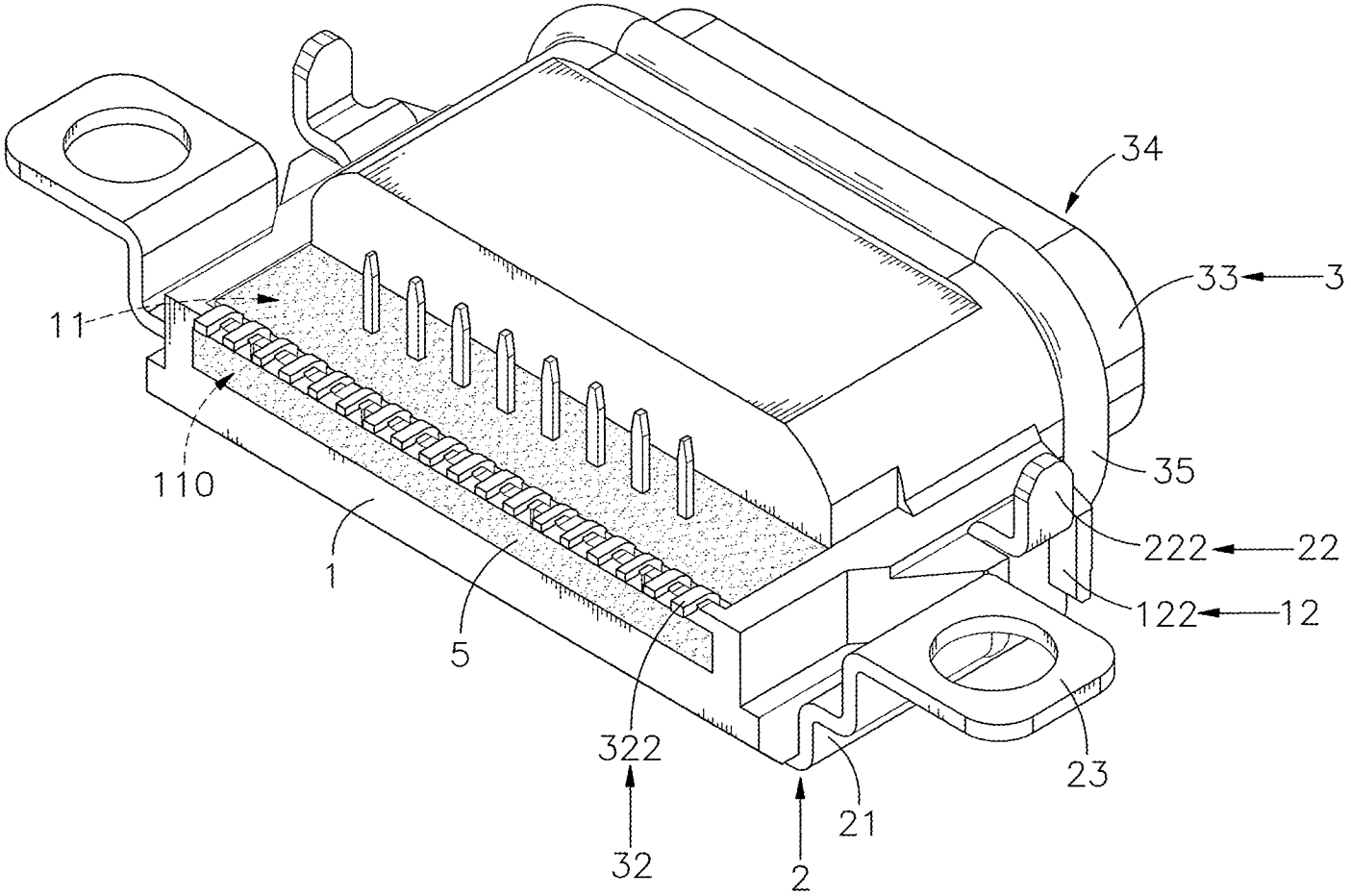
FIG. 10 is an oblique rear elevational upside-down view of the waterproof electric connector assembly in accordance with the second embodiment of the present invention.

Referring to FIGS. 8-10, a waterproof electric connector assembly in accordance with a second embodiment of the present invention is shown. This second embodiment is substantially similar to the aforesaid first embodiment with the exceptions outlined hereinafter. The locating devices 12 of the electrically insulative housing 1 are respectively disposed at two opposite lateral sides relative to the front opening 101, each comprising two stop blocks 122 formed integral with the outside wall of the electrically insulative housing 1 and a position-limiting insertion hole 1220 defined between the two stop blocks 122.

The metal shielding cover 2 comprises a flat metal cover body 21, two L-shaped mounting flanges 23 respectively extended from the two opposite lateral sides of the flat metal cover body 21, and positioning means 22 respectively extended from two opposite lateral sides of the flat metal cover body 21 at a front side relative to the L-shaped mounting flanges 23. Each positioning means 22 comprises an angled plug rod 222. The angled plug rods 222 of the two positioning means 22 are respectively extended from the two opposite lateral sides of the flat metal cover body 21 and respectively set in the position-limiting insertion holes 1220 between the respective two stop blocks 122 of the respective locating devices 12 to secure the metal shielding cover 2 firmly to the electrically insulative housing 1.

As stated above, the metal shielding cover 2 of the waterproof electric connector assembly is covered on the top side of the electrically insulative housing 1 with the positioning means 22 of the metal shielding cover 2 fastened to the locating devices 12 of the electrically insulative housing 1; the electric connector 3 is mounted in the accommodation chamber 110 of the electrically insulative housing 1; the conducting terminal set 32 of the electric connector 3 has the conducting terminal contact portions 321 thereof respectively arranged on the opposing top and bottom walls of the tongue plate 311 and the conducting terminal bonding portions 322 thereof extended out of the recessed bottom chamber 112; the insertion chamber 330 of the metal shielding shell 33, the tongue plate 311 and the conducting terminal contact portions 321 of the conducting terminal set 32 constitute the plug-in unit 34 that extends out of the front opening 101 of the electrically insulative housing 1; the gasket ring 35 is mounted on the plug-in unit 34; the waterproof adhesive 5 fills up the recessed bottom chamber 112. Thus, the gasket ring 35 and the waterproof adhesive 5 provide the area around the plug-in unit 34 and the recessed bottom chamber 112 with a waterproof function. Further, the back cover sheet 4 is attached to the electrically insulative housing 1 to block the through holes 115 when filling the waterproof adhesive 5 in the recessed bottom chamber 112, avoiding overflow of the waterproof adhesive 5 and enabling the recessed bottom chamber 112 to be well sealed.

In conclusion, the invention provides a waterproof electric connector assembly, which comprises an electrically insulative housing that comprises an accommodation chamber, a recessed bottom chamber and a front opening, a metal shielding cover covered on the top side of the electrically insulative housing, an electric connector mounted in the accommodation chamber with a plug-in unit thereof extended out of the front opening of the electrically insulative housing and the conducting terminal bonding portions of the conducting terminal set thereof extended out of the recessed bottom chamber, a gasket ring mounted on the plug-in unit, and a waterproof adhesive filled up the recessed bottom chamber. Thus, the electric connector assembly achieves good waterproofing effect. The waterproof electric connector assembly enables the area around the plug-in unit and the area around the conducting terminal bonding portions of the conducting terminal set to be well protected against moisture permeation, preventing moisture damage to the bonded circuit board.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A waterproof electric connector assembly, comprising:

an electrically insulative housing comprising an accommodation chamber, a front opening located in a front side thereof and disposed in communication with said accommodation chamber, a recessed bottom chamber located in a rear bottom side thereof, and two locating devices respectively at two opposite lateral sides thereof;

a metal shielding cover surrounding said electrically insulative housing, said metal shielding cover comprising two positioning means respectively extended from two opposite lateral sides of said flat metal cover body and respectively fastened to said locating devices of said electrically insulative housing; and an electric connector mounted in said accommodation chamber of said electrically insulative housing, said electric connector comprising an electrically insulative terminal block, a tongue plate forwardly extended from a front side of said electrically insulative terminal block and inserted through said front opening of said electrically insulative housing, a metal shielding shell surrounding said electrically insulative terminal block and said tongue plate, and a conducting terminal set embedded in said electrically insulative terminal block, said conducting terminal set comprising a plurality of conducting terminal contact portions located at a front side thereof and respectively positioned in opposing top and bottom walls of said tongue plate and a plurality of conducting terminal bonding portions located at an opposing rear side thereof and extended out of said recessed bottom chamber of said electrically insulative terminal block; and a waterproof adhesive sealed up said recessed bottom chamber of said electrically insulative housing.

2. The waterproof electric connector assembly as claimed in claim 1, wherein said electrically insulative housing further comprises a plurality of through holes cut through a back wall thereof and disposed in communication with said recessed bottom chamber, and a back cover sheet detachably attached to the said back wall to cover said through holes before filling of said waterproof adhesive in said recessed bottom chamber, said back cover sheet being selected from the group of Mylar film, plastic film and silicone film.

3. The waterproof electric connector assembly as claimed in claim 1, wherein each said locating device of said electrically insulative housing comprises a locating block formed integral with an outside wall of said electrically insulative housing and a plug hole defined in said locating block; said metal shielding cover further comprises two L-shaped mounting flanges respectively extended from the said two opposite lateral sides of said flat metal cover body; each said positioning means comprises a plug rod extended from said flat metal cover body and plugged into the said plug hole in the respective said locating block of the respective said locating device.

4. The waterproof electric connector assembly as claimed in claim 1, wherein each said locating device of said electrically insulative housing comprises two stop blocks, and a position-limiting insertion hole defined between said two stop blocks; each said positioning means of said metal shielding cover comprises an angled plug rod extended from respective one side of said metal cover body and positioned in the respective said position-limiting insertion hole between the respective said two stop blocks of the respective said locating device to secure said metal shielding cover to said electrically insulative housing.

5. The waterproof electric connector assembly as claimed in claim 4, wherein said metal shielding shell defines therein an insertion chamber that accommodates said tongue plate; said insertion chamber of said metal shielding shell, said tongue plate and said conducting terminal contact portions of said conducting terminal set constitute a plug-in unit conforming to the Universal Serial Bus (USB Type-C) specification.

6. The waterproof electric connector assembly as claimed in claim 1, wherein said electrically insulative housing is molded on said electric connector using insert molding technology, allowing said metal shielding shell, said tongue plate and said conducting terminal contact portions of said conducting terminal set to be partially extended out of said front opening of said electrically insulative housing.

* * * * *